United States Patent [19]

Bickle

[11] 4,438,537

[45] Mar. 27, 1984

[54] LIQUID DIRECTIONAL FLOW APPARATUS

[76] Inventor: Damon R. Bickle, 6 Rustic St., Kenmore, Queensland, Australia, 4069

[21] Appl. No.: 370,067

[22] Filed: Apr. 20, 1982

Related U.S. Application Data

[63] Continuation-in-part of Ser. No. 352,566, Feb. 26, 1982, abandoned.

[30] Foreign Application Priority Data

Mar. 2, 1981 [AU] Australia ..... PE7792

[51] Int. Cl.[3] ..... E04H 3/16; E04H 3/18

[52] U.S. Cl. ..... 4/492; 4/541; 239/428.5; 239/587

[58] Field of Search ..... 4/541, 542, 492, 490; 239/587, 428.5

[56] References Cited

U.S. PATENT DOCUMENTS

| | | | |
|---|---|---|---|
| 3,605,735 | 9/1971 | Soden | 4/541 X |
| 3,727,843 | 4/1973 | Parilla | 239/587 X |
| 3,985,303 | 10/1976 | Steimle | 239/428.5 |
| 4,262,371 | 4/1981 | Berry et al. | 4/492 X |
| 4,264,039 | 4/1981 | Moreland | 4/492 |
| 4,320,541 | 3/1982 | Neenan | 4/492 |
| 4,335,854 | 6/1982 | Reynoso | 239/428.5 |
| 4,349,923 | 9/1982 | Chalberg | 4/541 |

*Primary Examiner*—Henry K. Artis

*Attorney, Agent, or Firm*—Cushman, Darby & Cushman

[57] ABSTRACT

This invention relates to a liquid directional flow apparatus which includes mounting means such as an elongate mounting tube having an inner portion attached to an outlet pipe of a swimming pool or other liquid retaining structure and liquid directional flow means associated with the mounting means. Preferably the mounting tube has an outer portion which is enlarged relative to the inner portion and functions as a socket for the liquid directional flow means which is preferably a pivot flow ball member. The arrangement is such that in the case of the apparatus being installed to an outlet pipe of the swimming pool or other liquid retaining structure which is offset to the planar or substantially planar outer face of a wall of the swimming pool or structure that the liquid directional flow means may be adjusted to any desired setting or orientation.

4 Claims, 1 Drawing Figure

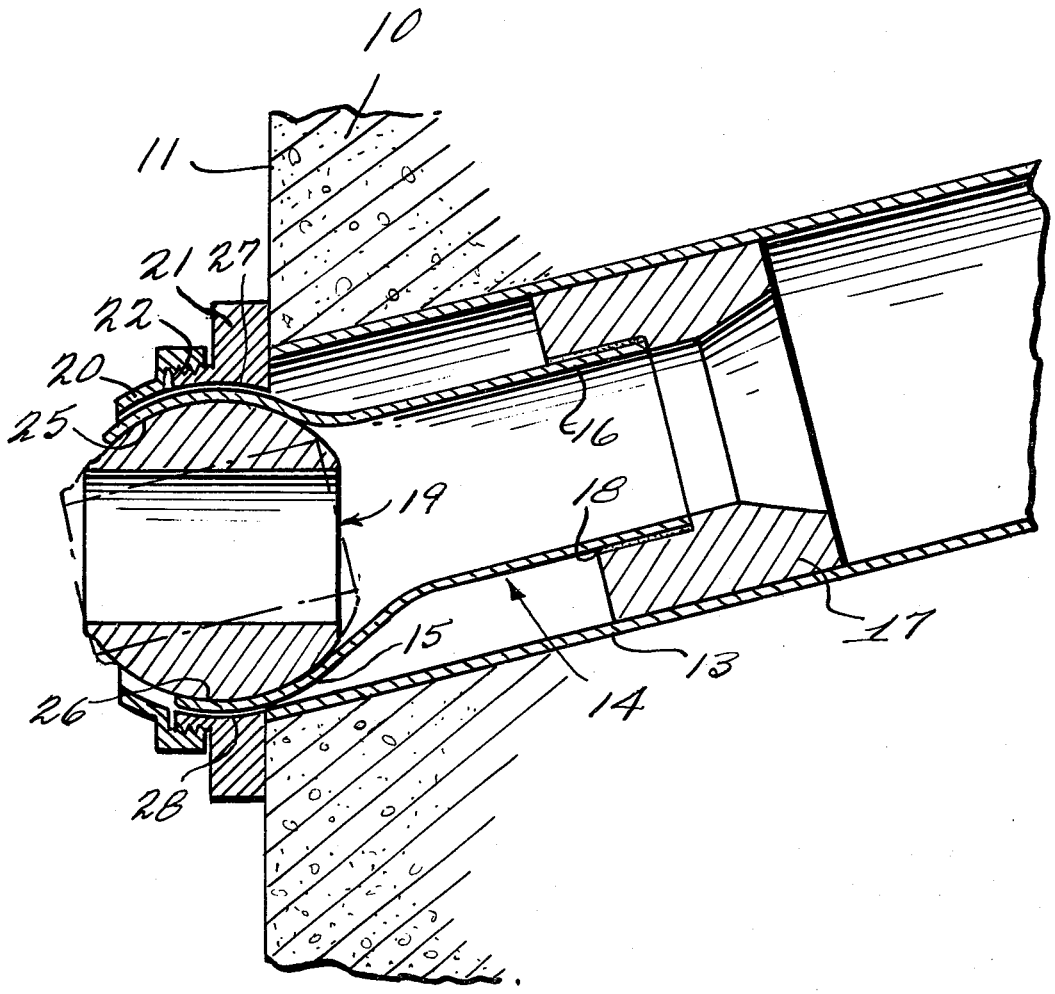
10
11
21
27
22
20
25
16
19
18
15
13
17
14
26
28

LIQUID DIRECTIONAL FLOW APPARATUS

This is a continuation-in-part of my copending application, Ser. No. 352,566 filed Feb. 26, 1982, abandoned.

This invention relates to a liquid directional flow apparatus which may be used in swimming pools, tanks, and other liquid retaining structures.

Hitherto outlet pipes of swimming pools have been fitted with a directional flow fitting or "eyeball" fitting which is useful in that it may pivot or swivel with respect to the longitudinal axis of the outlet pipe and thus direct the flow of water into the pool at any desired angle. In some cases however, the water outlet pipe of the swimming pool was offset to the plane of the vertical face of the side wall of the pool and when the directional flow fitting was fitted to the offset outlet pipe the directional flow or efficiency of the water jet was reduced because it was only designed to function with an outlet pipe that was normal to the vertical face of the side wall of the swimming pool. There were also associated problems wherein when the directional flow fitting was attached to an offset water outlet pipe it was untidy and non-professional in appearance causing difficulties when tiling of the side wall of the pool was carried out.

It is therefore an object of the invention to provide liquid outlet directional flow apparatus that alleviates the abovementioned problems associated with the prior art.

The liquid directional flow apparatus of the invention includes:

mounting means associated with an outlet or inlet pipe of a swimming pool or other liquid retaining structure; and liquid directional flow means associated therewith;

the construction and arrangement being such in the case of the liquid directional flow apparatus being installed to an outlet pipe of the swimming pool or other liquid retaining structure which is offset to the planar or substantially planar outer face of a wall of the swimming pool or liquid containing structure said liquid direction flow means may be adjusted to any desired setting or orientation.

The mounting means in a preferred form of the invention may include an elongate mounting tube having an inner portion associated with the inlet or outlet pipe of the liquid containing structure and an outer portion which is suitably enlarged relative to the inner portion and most preferably is bulbous or has a side wall portion which curves arcuately and outwardly relative to the inner portion.

Preferably the enlarged curved outer portion of the mounting tube is of a complementary shape so as to accommodate or receive the liquid direction flow means which is suitably a pivotal flow member as described hereinafter.

Suitably the pivotal flow member includes a substantially part spherical member which is open ended at each end. In other words, it may be of substantially spherical segmental shape and most preferably may comprise the central portion of a sphere with the ends removed. The pivotal flow member may be provided with an outer end flange which surrounds an outer end orifice of restricted size or diameter compared to the remainder of the bore or interior of the pivotal flow member.

However it will be appreciated that the pivotal flow member may be any suitable shape which is complementary to the outer portion of the mounting tube and which allows the pivotal flow member to freely pivot thereto.

Preferably however the pivotal flow member is an "eyeball" fitting as described previously.

The inner portion of the mounting tube may be accommodated within the bore of a fixing member or tube which may be attached to the outlet or inlet pipe of the liquid retaining structure in any suitable manner such as by being bonded thereto by any suitable adhesive such as PVC solvent cement. The fixing tube will have a longitudinal axis that will be the same or coincide with the longitudinal axis of the inlet or outlet tube. It may have a proximal end portion having a mounting shoulder or ledge so as to receive the inner portion of the mounting tube. The inner portion of the mounting tube may also be bonded to the interior adjacent portion of the fixing tube.

There also may be provided a clamping ring which surrounds the enlarged outer portion of the mounting tube and clamps the rigid mounting tube in place so that it forms a suitable stationary support for the pivotal flow member. Preferably however there is provided inner and outer clamping rings which have an inner curvature complementary to the outer surface of outer portion of the mounting tube. The two clamping rings may be attached to each other by any suitable means such as a screw inserted through coaligned apertures in each ring. Alternatively there may be provided locating pins and accommodating sockets in each ring.

It will be found that the liquid directional flow apparatus of the invention will be effective in use in enabling the pivotal flow member or "eyeball" to assume an orientation substantially flush with the surrounding wall of a swimming pool for example and thus be effective in operation as well as presenting a neat appearance when attached to the wall.

Reference may now be made to a preferred embodiment of the invention as shown in the attached drawing wherein 10 represents the side wall of a swimming pool having outer face 11 and 13 is an offset outlet pipe of the swimming pool. There is also included elongate mounting tube 14 having an enlarged outer portion 15 and inner portion 16 rigidly attached to fixing tube 17 by adhesive. Fixing tube 17 includes mounting shoulder 18 to receive inner portion 16 of mounting tube 14.

Pivotally mounted in outer portion 15 of mounting tube 14 is an "eyeball" fitting 19. There is also provided an outer clamping ring 20 which engages with an inner clamping ring 21 in a screw threaded manner at 22.

When the liquid directional flow apparatus of the invention is installed in the wall 10, relative movement may be achieved between the inner clamping ring 21 and mounting tube 14 because of complementary curved surfaces 27 and 28 so as to allow mounting ring 21 to assume a position or orientation substantially flush or contiguous with outer face 11 or even parallel thereto. This feature is important in that it removes the impediment of the outlet tube having an offset entry to the pool as discussed above relative to the prior art.

The eyeball fitting 19 may be freely pivoted in its mating socket with reference to complementary curved surfaces 25 and 26 when the outer ring 22 is either partially unscrewed or completely unscrewed from inner ring 21. This allows fitting 19 to be readily adjustable and thus be moved to a desired setting by the pool owner to give adequate control of entry of water into the pool. When ring 22 is completely tightened the fitting 19 is locked into the desired position or orientation and is not movable.

I claim:

1. A liquid directional flow apparatus including:

an elongate mounting tube having an inner portion engageable in an outlet pipe of a swimming pool and an outer portion which is enlarged relative to the inner portion and wherein the outer portion has a side wall that curves outwardly and then inwardly relative to the longitudinal axis of the elongate mounting tube; an eyeball shaped nozzle having a channel extending therethrough which is mounted in the outer portion of the mounting tube and wherein the outer surface of the nozzle has a curvature at least substantially complementary to the inner surface of the outer portion whereby said nozzle may be pivoted relative to said mounting tube; and an inner clamping ring having a curved inner surface engageable with a curved outer surface of said outer portion of the mounting tube and pivotable thereto during installation; and locking means engageable with said inner clamping ring to orient the inner clamping ring in a direction substantially parallel to the plane of an outer wall of the swimming pool when the liquid directional flow apparatus is installed in said outlet pipe to enable the eyeball nozzle to be oriented in a direction substantially normal to the plane of said outer wall.

2. Liquid directional flow apparatus as claimed in claim 1 wherein the inner portion of the mounting tube in use is rigidly secured to a fixing tube located in the internal bore of the outlet pipe.

3. A liquid directional flow apparatus as claimed in claim 1 wherein the locking means includes an outer clamping ring having an inner surface engageable with the curved outer surface of the outer portion of the mounting tube and also being screw threadedly engaged with the inner clamping ring in use.

4. A liquid directional flow apparatus as claimed in claim 1 wherein the inner clamping ring includes a rear part which extends through an aperture in the outer wall of the swimming pool in use and wherein said inner clamping ring may be retained in position by a washer screw threadedly engaging said rear part.

* * * * *